US010029280B2

(12) United States Patent
Hung et al.

(10) Patent No.: US 10,029,280 B2
(45) Date of Patent: Jul. 24, 2018

(54) SIEVE FOR MICROPARTICLES

(71) Applicant: METAL INDUSTRIES RESEARCH & DEVELOPMENT CENTRE, Kaohsiung (TW)

(72) Inventors: Cheng-Han Hung, Kaohsiung (TW); Zong-Hsin Liu, Kaohsiung (TW); Ying-Chieh Lin, Kaohsiung (TW); Ming-Fang Tsai, Kaohsiung (TW); Chia-Ming Jan, Kaohsiung (TW); Yun-Lung Huang, Kaohsiung (TW); Hai-Ching Tsou, Kaohsiung (TW); Ying-Cheng Lu, Kaohsiung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 0 days.

(21) Appl. No.: 15/378,364

(22) Filed: Dec. 14, 2016

(65) Prior Publication Data

US 2018/0161819 A1 Jun. 14, 2018

(51) Int. Cl.
*B07B 1/46* (2006.01)
*B07B 1/12* (2006.01)

(52) U.S. Cl.
CPC ..... *B07B 1/12* (2013.01); *B07B 1/4609* (2013.01); *B07B 1/4645* (2013.01)

(58) Field of Classification Search
CPC .... B07B 1/00; B07B 1/04; B07B 1/12; B07B 1/4609; B07B 1/4645
USPC ..... 209/311, 315, 319, 353, 355
See application file for complete search history.

(56) References Cited

U.S. PATENT DOCUMENTS 4,239,728 A * 12/1980 Stenberg ..... B01D 63/082 128/DIG. 3
4,430,218 A * 2/1984 Perl ..... B01D 53/22 210/321.75
4,624,784 A * 11/1986 Lefebvre ..... B01D 61/18 210/321.67
4,867,876 A * 9/1989 Kopf ..... B01D 25/215 210/228
5,232,589 A * 8/1993 Kopf ..... B01D 25/215 210/228
5,868,930 A * 2/1999 Kopf ..... B01D 63/081 210/231
6,592,815 B1 * 7/2003 Zimmer ..... G01N 33/525 422/412
6,698,592 B2 * 3/2004 Kenning ..... B01D 45/08 209/143
7,147,109 B2 * 12/2006 Stichert ..... B01J 19/0046 209/311
7,316,780 B1 * 1/2008 Fendya ..... A23C 9/1422 210/503

(Continued)

*Primary Examiner* — Joseph C Rodriguez
(74) *Attorney, Agent, or Firm* — Alan D. Kamrath; Kamrath IP Lawfirm, P.A.

(57) ABSTRACT

A sieve for microparticles includes a seat having a chamber and a plurality of boards mounted in the chamber. Each of the plurality of boards includes a first face and a second face opposite to the first face. The first face includes at least one notch. The second face includes at least one groove. The first face of each of the plurality of boards abuts the second face of an adjacent board. The at least one notch and the at least one groove respectively of two adjacent boards are partially aligned and intercommunicated with each other.

19 Claims, 5 Drawing Sheets

(56) References Cited

U.S. PATENT DOCUMENTS

| | | | | |
|---|---|---|---|---|
| 7,635,426 | B2 * | 12/2009 | Weinstein | B01D 63/084 210/224 |
| 2003/0132162 | A1 * | 7/2003 | Busnach | B01D 61/18 210/650 |
| 2012/0205306 | A1 * | 8/2012 | Reich | A61M 1/3472 210/519 |

* cited by examiner

SIEVE FOR MICROPARTICLES

BACKGROUND

1. Technical Field

The present invention relates to a tool for sieving microparticles and, more particularly, to a sieve for microparticles to increase the uniformity of microparticles obtained after sieving.

2. Description of the Related Art

In recent years, production and applications of microparticles are more and more extensive. Nevertheless, microparticles must be sieved to obtain diameter uniformity in many applications. However, current sieves are made by weaving, such that the precision of the micropores is not good enough (even a sieve having the best precision has a tolerance as high as ±20 μm). Furthermore, the micropores of the sieves are often blocked after a period of time of use, and the blockage is difficult to be fully cleared even by high pressure fluid impact that undesirably deforms the sieves and, thus, reduces the precision. Thus, blocked sieves are replaced by new sieves in current processing, leading to wasting of resources and causing difficulties in reduction of the costs.

Thus, improvement to the conventional tools for sieving microparticles is necessary.

SUMMARY

To solve the above problem, the present invention provides a sieve for microparticles to increase the precision of the micropores, such that the sieved microparticles have a better diameter uniformity.

The present invention provides a sieve for microparticles including detachable components that can be assembled to form micropores. The sieve can be detached when the micropores are blocked, permitting easy cleaning for repeated use.

The directional terms or similar terms, such as "front", "rear", "upper", "top", "lower", "bottom", "inner", "outer", and "side", used in the present invention are referred to in connection with the accompanying drawings. The directional terms or similar terms are merely used to assist in describing and understanding the embodiments of the present invention, rather than restricting the present invention.

A sieve for microparticles according to the present invention includes a seat having a chamber and a plurality of boards mounted in the chamber. Each of the plurality of boards includes a first face and a second face opposite to the first face. The first face includes at least one notch. The second face includes at least one groove. The first face of each of the plurality of boards abuts the second face of an adjacent board. The at least one notch and the at least one groove respectively of two adjacent boards are partially aligned and intercommunicated with each other.

Thus, the sieve for microparticles according to the present invention can increase the precision of the micropores, such that the sieved microparticles have a better diameter uniformity. Furthermore, the sieve for microparticles according to the present invention uses detachable components that are assembled to form micropores, such that the sieve can be detached, washed, and used repeatedly when the micropores are blocked, thereby reducing the sieving costs.

In an example, each of the plurality of boards further includes a third face and a fourth face opposite to the third face. The first face is connected to the third face and the fourth face. The second face is connected to the third face and the fourth face. The at least one notch extends to the third face. The at least one groove extends to the fourth face. Such a structure is easy to manufacture to reduce the manufacturing costs.

In an example, the seat includes a through-slot intercommunicated with the chamber. The fourth face of each of the plurality of boards is contiguous to the through-slot. Such a structure increases convenience of collection of the microspheres after sieving.

In an example, the depth of the at least one groove increases from an end thereof adjacent to the third face toward the other end thereof. Such a structure avoids capillary action, and the pressure of the fluid entering the at least one groove is reduced, thereby avoiding resistance during flow of the microspheres. Thus, the sieving efficiency of the microparticles is increased.

In an example, the at least one groove between two adjacent boards has a tapered shape, and the tapered shape has an angle of 2-10 degrees. Such a structure is easy to form while maintaining a good structural strength of the boards. The processing convenience of the at least one groove is increased while reliably avoiding deformation of the boards.

In an example, each of the first face and the second face of each of the plurality of boards is plated with a hydrophobic film or a smooth film to further increase the flowability of the fluid and the microspheres.

In an example, the at least one groove includes a plurality of grooves disposed along a longitudinal direction of the plurality of boards. A separation portion is formed between two adjacent grooves and includes an abutment face coplanar with the second face. Such a structure maintains the boards to avoid deformation under pressure, thereby more precisely controlling the size of the sieved microparticles.

In an example, the at least one groove includes only one groove extending along a longitudinal direction of the plurality of boards and having rectangular cross sections. Such a structure permits easy processing for forming each board while increasing the sieving efficiency of the microparticles.

In an example, the seat including a base, a plurality of lateral beams, and a plurality of pressing beams. The plurality of lateral beams is mounted on an upper surface of the base. The plurality of pressing beams is detachably assembled to end faces of the plurality of lateral beams by a plurality of fasteners. The base, the plurality of lateral beams, and the plurality of pressing beams together define the chamber. Such a structure permits the whole sieve to be easily detached, providing operational convenience for cleaning the boards.

In an example, each of the plurality of fasteners is a screw to permit adjustment of the pressing tightness exerted by the pressing beams against the boards, thereby achieving micro adjustment of the diameter of the microparticles to be sieved.

The present invention will become clearer in light of the following detailed description of illustrative embodiments of the present invention described in connection with the drawings.

DETAILED DESCRIPTION

Figure 1:
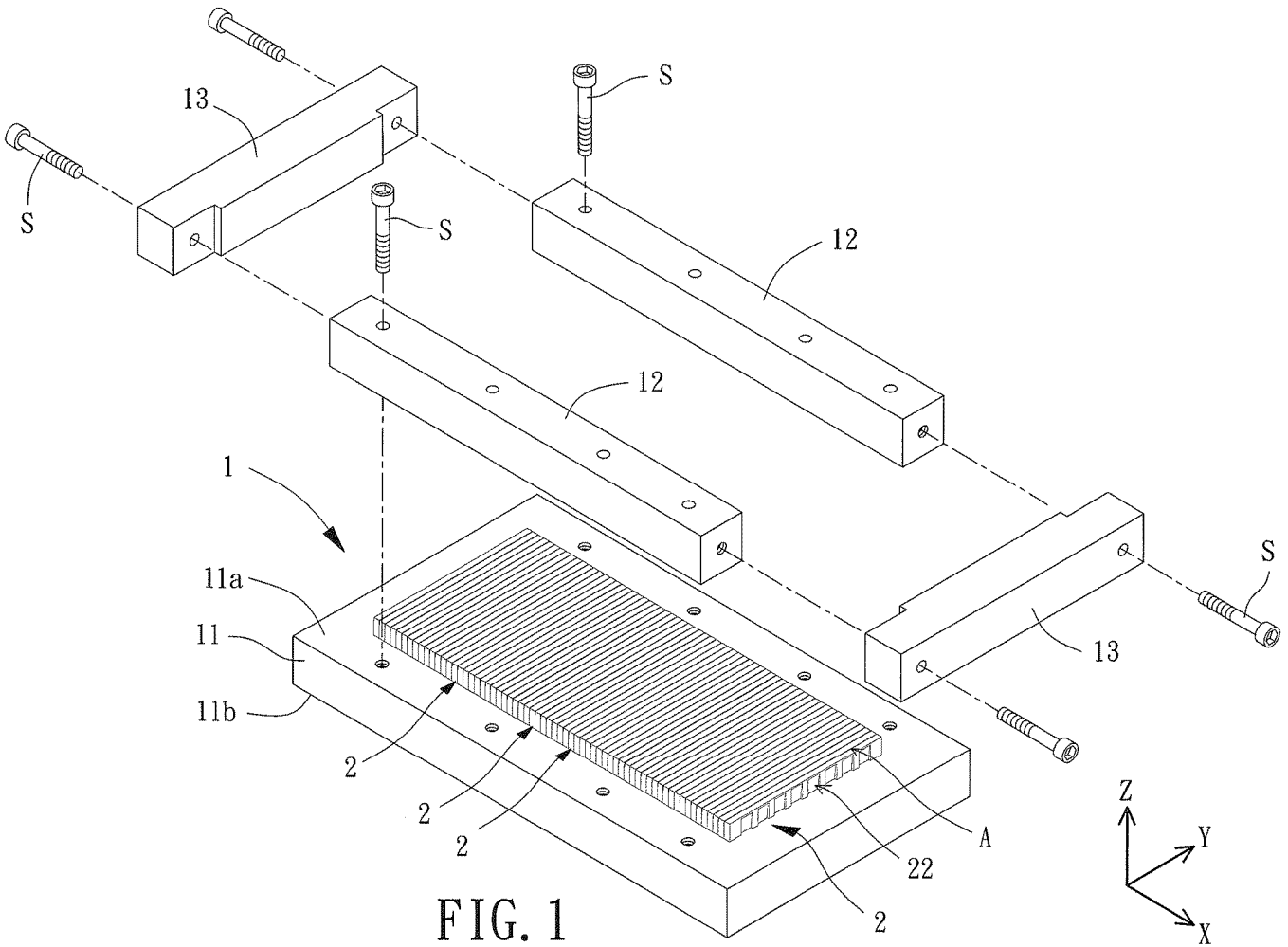
FIG. 1 is an exploded, perspective view of a sieve for microparticles of an embodiment according to the present invention.

With reference to FIG. 1, a sieve for microparticles of an embodiment according to the present invention includes a seat 1 and a plurality of boards 2 stacked in the seat 1.

The seat 1 is not limited in shape. In the embodiment shown in FIGS. 1 and 2, the seat 1 includes a base 11, a plurality of lateral beams 12, and a plurality of pressing beams 13. The base 11 includes an upper surface 11*a* and a lower surface 11*b* opposite to the upper surface 11*a*. The lateral beams 12 and pressing beams 13 are mounted on the upper surface 11*a* of the base 11. The base 11, the lateral beams 12, and the pressing beams 13 together define an open chamber R. The base 11 further includes a through-slot 111 extending from the upper surface 11*a* through the lower surface 11*b*. The through-slot 111 is intercommunicated with the chamber R.

In a non-restrictive example, the through-slot 111 in this embodiment has rectangular cross sections. Thus, the seat 1 includes two lateral beams 12 opposite to each other and two pressing beams 13 opposite to each other. The two lateral beams 12 and the two pressing beams 13 are mounted along a periphery of the through-slot 111. Preferably, the two lateral beams 12 are detachably assembled by fasteners S to the upper surface 11*a* of the base 11 to increase the operational convenience during assembly of the boards 2. Preferably, the two pressing beams 13 are detachably assembled by fasteners S to end faces of the two lateral beams 12. The fasteners S are preferably screws to permit adjustment of the pressing tightness exerted by the two pressing beams 13 against the boards 2.

Figure 3:
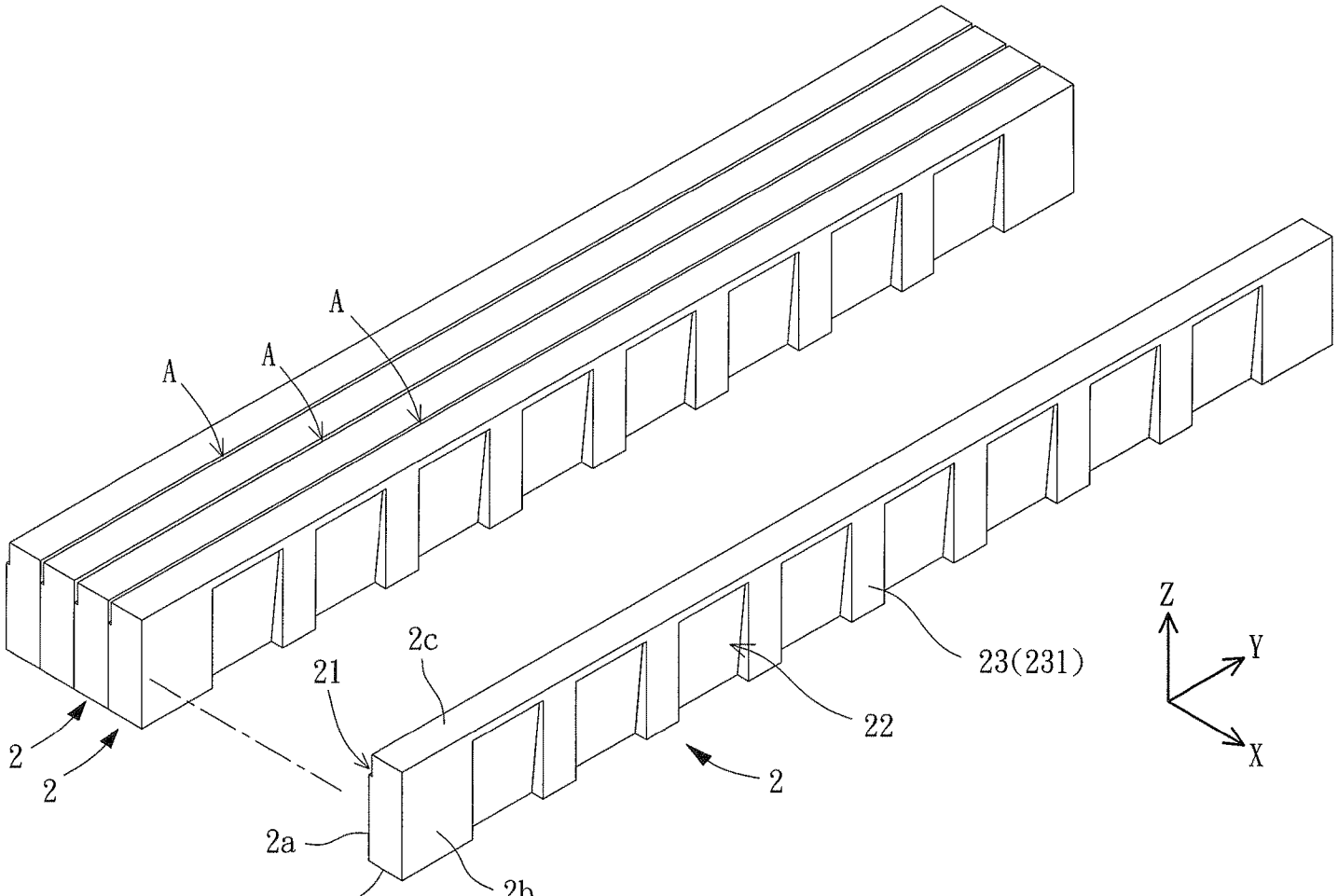
FIG. 3 is a perspective view, partly exploded, of a plurality of boards of the sieve of FIG. 1.
Figure 4:
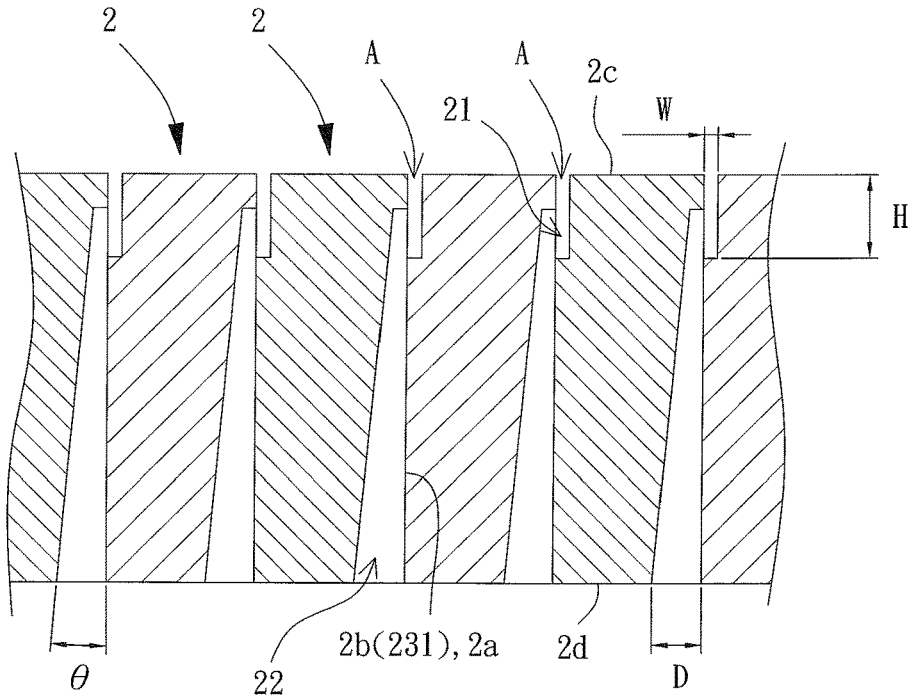
FIG. 4 is a diagrammatic cross sectional view of a portion of the boards of FIG. 3.

With reference to FIGS. 3 and 4, each board 2 can be made of stainless steel. In this embodiment, each board 2 has a thickness direction X, a longitudinal direction Y orthogonal to the thickness direction X, and a height direction Z orthogonal to the thickness direction X and the longitudinal direction Y. Each board 2 includes a first face 2*a* and a second face 2*b* opposite to the first face 2*a* in the thickness direction X. The first face 2*a* includes at least one notch 21. The second face 2*b* includes at least one groove 22. The first face 2*a* of each board 2 abuts the second face 2*b* of an adjacent board 2, such that the at least one notch 21 and the at least one groove 22 respectively of two adjacent boards 2 are partially aligned and intercommunicated with each other. Furthermore, each notch 21 and the second face 2*b* of an adjacent board 2 form a micropore A having a width W. The minimal value of the width W is about 5 μm. The maximal value of the width W of the micropore A is not limited. However, the maximal value of the width W of the micropore A can be selected according to need and is generally 1000 μm or smaller.

Figure 6:
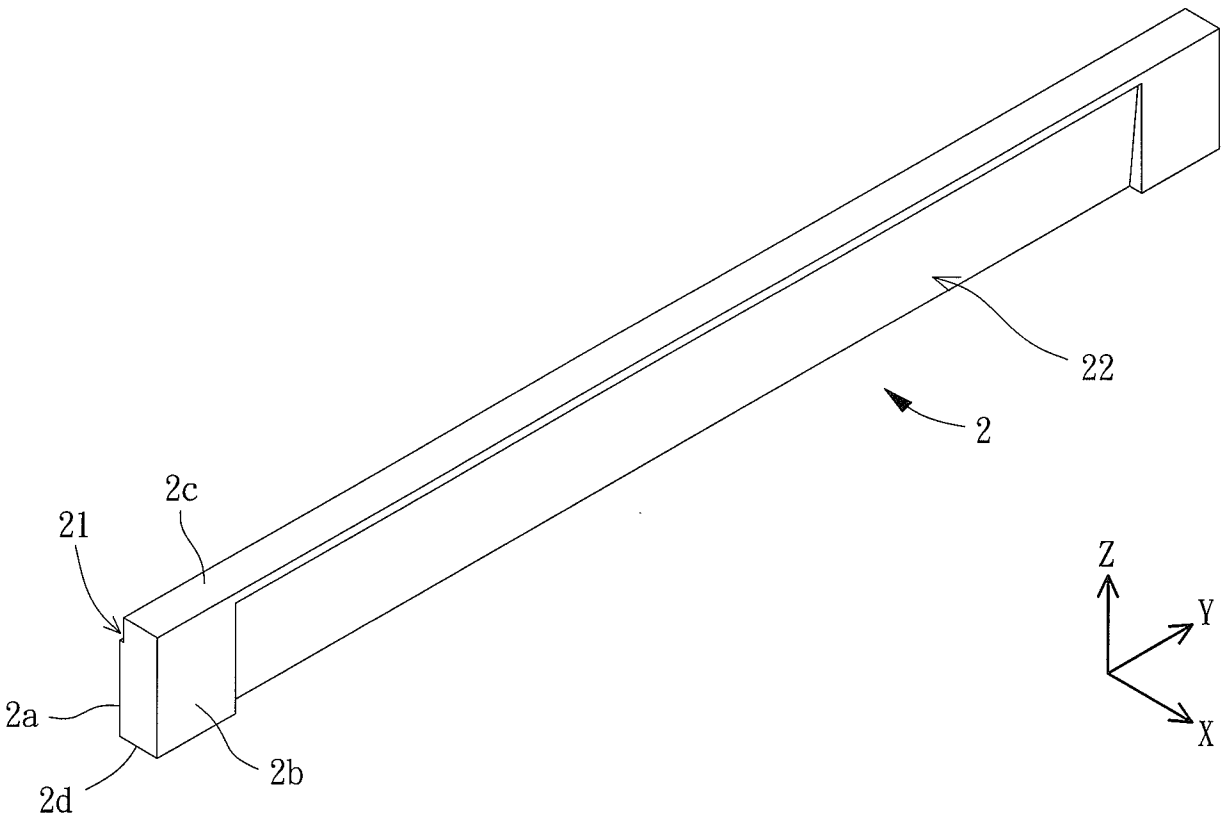
FIG. 6 is a diagrammatic perspective view of a board of another embodiment according to the present invention.

In an embodiment shown in FIG. 3, each board 2 includes a plurality of grooves 22 disposed along the longitudinal direction Y. A separation portion 23 is formed between two adjacent grooves 22 and includes an abutment face 231 coplanar with the second face 2*b*. Thus, when two adjacent boards 2 abut each other (see FIG. 4), the second face 2*b* and the abutment faces 231 of one of the boards 2 abut the first face 21*a* of the other board 2. As a result, the separation portions 23 maintain the boards 2 to avoid deformation under pressure, thereby more precisely controlling the size of the sieved microparticles. In another embodiment shown in FIG. 6, each board 2 includes only one groove 22 in the form of an elongated groove extending along the longitudinal direction Y and having rectangular cross sections, permitting easy processing for forming the boards 2. Furthermore, the sieving efficiency can be increased in this embodiment without stopping by the separation portions 23 (see FIG. 3).

With reference to FIGS. 3 and 4, each board 2 further includes a third face 2*c* and a fourth face 2*d* opposite to the third face 2*c* in the height direction Z. The first face 2*a* is connected to the third face 2*c* and the fourth face 2*d*. The second face 2*b* is also connected to the third face 2*c* and the fourth face 2*d*. The at least one notch 21 of each board 2 extends to the third face 2*c* and has a depth H of about 0.1-5 mm. The at least one groove 22 extends to the fourth face 2*d*. Thus, microparticles of a certain size can move from the third face 2*c* of one of the boards 2 through the at least one notch 21 of the at least one board 2 into the groove 22 of an adjacent board 2 and can then be sieved out of the fourth face 2*d* of the adjacent board 2.

To improve the microparticle sieving efficiency of the boards 2, the depth D of the at least one groove 22 of each board 2 preferably increases from an end thereof adjacent to the third face 2*c* toward the other end thereof. Thus, each groove 22 between two adjacent boards 2 has a tapered shape, and the tapered shape has an angle θ of 2-10 degrees. Consequently, each groove 22 can be formed easily while maintaining a good structural strength for each board 2. Deformation is, thus, difficult to occur. Furthermore, the groove 22 can avoid capillary action, and the pressure of the fluid entering the groove 22 is reduced, thereby avoiding resistance during flow of the microspheres. Furthermore, each of the first face 2*a* and the second face 2*b* of each board 2 is plated with a film, such as a hydrophobic film or a smooth film, to further increase the flowability of the fluid and the microspheres.

Figure 2:
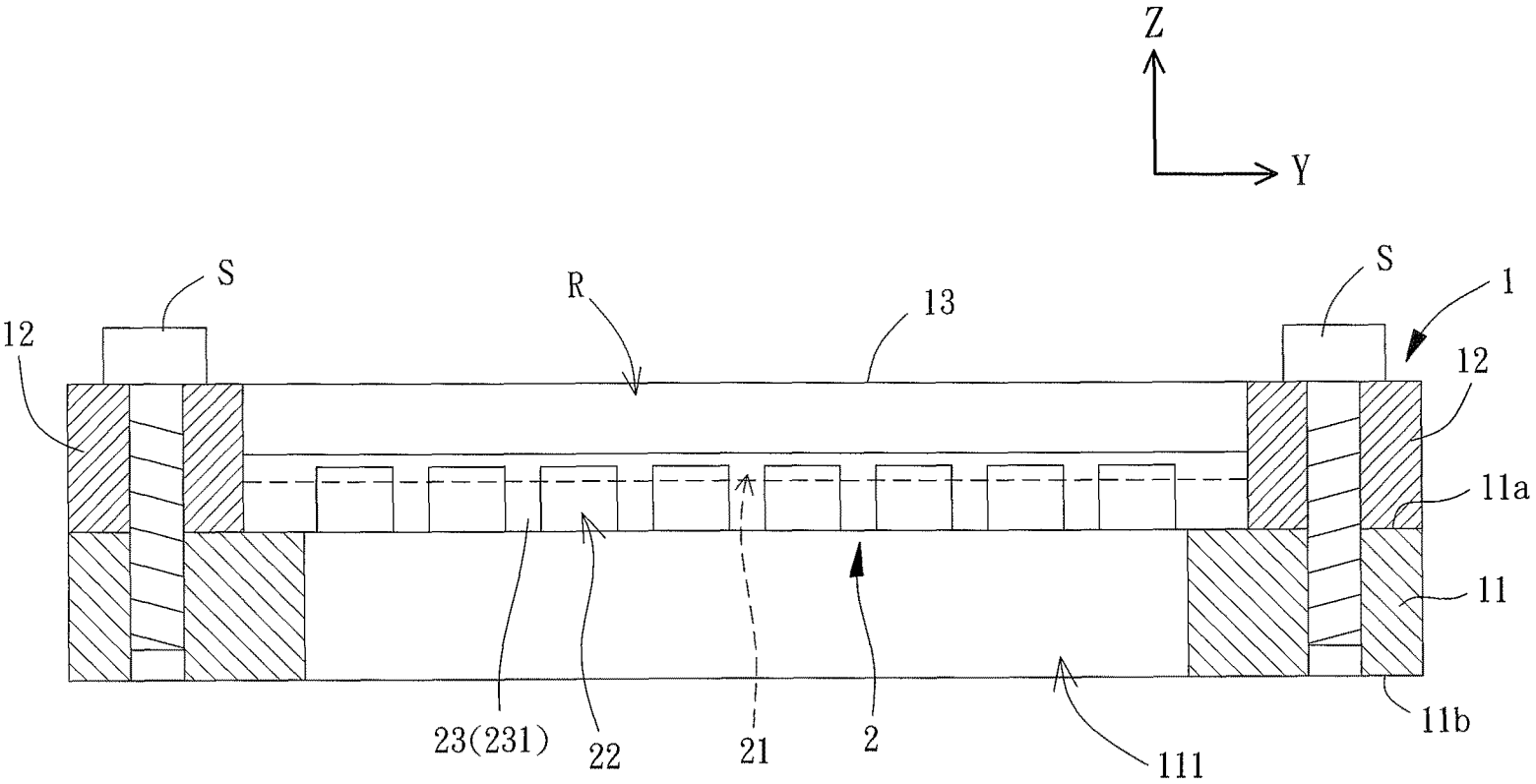
FIG. 2 is a cross sectional view of the sieve of FIG. 1 after assembly.

With reference to FIGS. 1 and 2, in assembly, the lateral beams 12 are positioned in the thickness direction X and are located on two sides of the stacked boards 2 in the longitudinal direction Y. Then, the pressing beams 13 are assembled to press against the boards 2 in the thickness direction X, and the stacked boards 2 are maintained in the chamber R of the seat 1. As shown in FIG. 4, the at least one notch 21 and the at least one groove 22 respectively of two adjacent boards 2 are partially aligned and intercommunicated with each other. Furthermore, the fourth face 2*d* of each board 2 is contiguous to the through-slot 111, such that the lower end of each groove 22 is contiguous to the through-slot 111.

Figure 5:
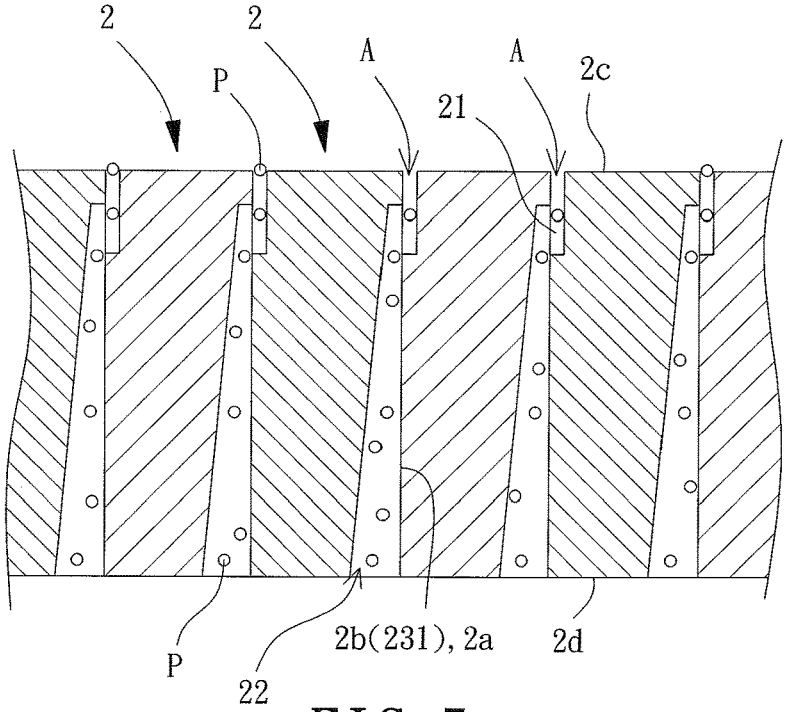
FIG. 5 is a diagrammatic view similar to FIG. 4, illustrating use of the sieve.

With reference to FIGS. 2 and 5, in use, the sieve for microparticles according to the present invention, can be placed on top of a collection tank (not shown). A fluid mixed with microparticles P of different diameters is poured from above the chamber R, such that microparticles P of a certain size can move from the third faces 2*c* of the boards 2 through the intercommunicated notches 21 and grooves 22 and can then be sieved out of the fourth face 2*d* of the boards 2.

In comparison with conventional sieves formed by weaving and including micropores having a tolerance of at least ±20 μm, the sieve for microparticles according to the present invention uses stacked boards 2 to form micropores A. Thus, the width W (FIG. 4) of each micropore A of two adjacent boards 2 (whose processing precision can be easily controlled) can be as small as about 5 μm, significantly increasing the diameter uniformity of the sieved microparticles P. Furthermore, in the sieve for microparticles according to the present invention, micro adjustment of the width W of each micropore A can be achieved by adjusting the pressing tightness exerted by the pressing beams 13 against the boards 2.

Furthermore, the sieve for microparticles according to the present invention is detachable, such that when the micropores A are blocked by the microparticles P, the stacked boards 2 can be detached and cleaned to easily remove the microparticles P adhered in the notches 21. After cleaning, the sieve for microparticles according to the present invention is reassembled to permit repeated use. Thus, it is not necessary to use a high pressure fluid to impact the boards 2, avoiding deformation of the boards 2 that will adversely affect the precision of the micropores A after reassembly. Furthermore, the sieve for microparticles according to the present invention can be used repeatedly to reduce wasting of resources, effectively reducing the sieving costs.

In view of the foregoing, the sieve for microparticles according to the present invention can increase the precision of the micropores A, such that the sieved microparticles P has a better diameter uniformity. Furthermore, the sieve for microparticles according to the present invention uses detachable components that are assembled to form micropores A, such that the sieve can be detached, washed, and used repeatedly when the micropores A are blocked, thereby reducing the sieving costs.

Thus since the present invention disclosed herein may be embodied in other specific forms without departing from the spirit or general characteristics thereof, some of which forms have been indicated, the embodiments described herein are to be considered in all respects illustrative and not restrictive. The scope of the present invention is to be indicated by the appended claims, rather than by the foregoing description, and all changes which come within the meaning and range of equivalency of the claims are intended to be embraced therein.

What is claimed is:

1. A sieve for microparticles, comprising:

a seat including a chamber; and a plurality of boards mounted in the chamber, with each of the plurality of boards including a first face and a second face opposite to the first face, with the first face including at least one notch, with the second face including at least one groove, with the first face of each of the plurality of boards abutting the second face of an adjacent board, and with the at least one notch and the at least one groove respectively of two adjacent boards being partially aligned and intercommunicated with each other, with each of the plurality of boards further including a third face and a fourth face opposite to the third face, with the first face connected to the third face and the fourth face, with the second face connected to the third face and the fourth face, with the at least one notch extending to the third face, and with the at least one groove extending to the fourth face.

2. The sieve for microparticles as claimed in claim 1, wherein the seat including a through-slot intercommunicated with the chamber, and wherein the fourth face of each of the plurality of boards is contiguous to the through-slot.

3. The sieve for microparticles as claimed in claim 1, wherein a depth of the at least one groove increases from an end thereof adjacent to the third face toward another end thereof.

4. The sieve for microparticles as claimed in claim 3, wherein the at least one groove between two adjacent boards has a tapered shape, and wherein the tapered shape has an angle of 2-10 degrees.

5. The sieve for microparticles as claimed in claim 1, wherein each of the first face and the second face of each of the plurality of boards is plated with a hydrophobic film or a smooth film.

6. The sieve for microparticles as claimed in claim 1, with the at least one groove including a plurality of grooves disposed along a longitudinal direction of the plurality of boards, with a separation portion formed between two adjacent grooves and including an abutment face coplanar with the second face.

7. A sieve for microparticles, comprising:

a seat including a chamber; and a plurality of boards mounted in the chamber, with each of the plurality of boards including a first face and a second face opposite to the first face, with the first face including at least one notch, with the second face including at least one groove, with the first face of each of the plurality of boards abutting the second face of an adjacent board, and with the at least one notch and the at least one groove respectively of two adjacent boards being partially aligned and intercommunicated with each other, with the at least one groove including only one groove extending along a longitudinal direction of the plurality of boards and having rectangular cross sections.

8. A sieve for microparticles, comprising:

a seat including a chamber, with the seat including a base, a plurality of lateral beams, and a plurality of pressing beams, with the plurality of lateral beams mounted on an upper surface of the base, with the plurality of pressing beams detachably assembled to end faces of the plurality of lateral beams by a plurality of fasteners, and with the base, the plurality of lateral beams, and the plurality of pressing beams together defining the chamber; and a plurality of boards mounted in the chamber, with each of the plurality of boards including a first face and a second face opposite to the first face, with the first face including at least one notch, with the second face including at least one groove, with the first face of each of the plurality of boards abutting the second face of an adjacent board, and with the at least one notch and the at least one groove respectively of two adjacent boards being partially aligned and intercommunicated with each other.

9. The sieve for microparticles as claimed in claim 8, wherein each of the plurality of fasteners is a screw.

10. The sieve for microparticles as claimed in claim 7, wherein the seat including a through-slot intercommunicated with the chamber, and wherein the fourth face of each of the plurality of boards is contiguous to the through-slot.

11. The sieve for microparticles as claimed in claim 7, wherein a depth of the at least one groove increases from an end thereof adjacent to the third face toward another end thereof.

12. The sieve for microparticles as claimed in claim 11, wherein the at least one groove between two adjacent boards has a tapered shape, and wherein the tapered shape has an angle of 2-10 degrees.

13. The sieve for microparticles as claimed in claim 7, wherein each of the first face and the second face of each of the plurality of boards is plated with a hydrophobic film or a smooth film.

14. The sieve for microparticles as claimed in claim 7, with the at least one groove including a plurality of grooves disposed along a longitudinal direction of the plurality of boards, with a separation portion formed between two adjacent grooves and including an abutment face coplanar with the second face.

15. The sieve for microparticles as claimed in claim 8, wherein the seat including a through-slot intercommunicated with the chamber, and wherein the fourth face of each of the plurality of boards is contiguous to the through-slot.

16. The sieve for microparticles as claimed in claim 8, wherein a depth of the at least one groove increases from an end thereof adjacent to the third face toward another end thereof.

17. The sieve for microparticles as claimed in claim 16, wherein the at least one groove between two adjacent boards has a tapered shape, and wherein the tapered shape has an angle of 2-10 degrees.

18. The sieve for microparticles as claimed in claim 8, wherein each of the first face and the second face of each of the plurality of boards is plated with a hydrophobic film or a smooth film.

19. The sieve for microparticles as claimed in claim 8, with the at least one groove including a plurality of grooves disposed along a longitudinal direction of the plurality of boards, with a separation portion formed between two adjacent grooves and including an abutment face coplanar with the second face.

* * * * *